US006361231B1

(12) United States Patent
Sato et al.

(10) Patent No.: US 6,361,231 B1
(45) Date of Patent: Mar. 26, 2002

(54) PRINTER HAVING A MEDIUM TRANSPORTATION PATH OPEN/CLOSE MECHANISM

(75) Inventors: Seiya Sato, Matsumoto; Kenichiro Arai, Shiojiri, both of (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/533,344

(22) Filed: Mar. 23, 2000

(30) Foreign Application Priority Data

Mar. 25, 1999 (JP) ..... 11-082573

(51) Int. Cl.[7] ..... B41J 11/26
(52) U.S. Cl. ..... 400/621; 400/120.16; 400/613
(58) Field of Search ..... 400/648, 649, 400/650, 691, 693, 120.16, 621, 613; 347/197, 220, 222

(56) References Cited

U.S. PATENT DOCUMENTS

| | | | | |
|---|---|---|---|---|
| 4,641,980 A | * | 2/1987 | Matsumoto et al. | 400/120 |
| 4,909,645 A | * | 3/1990 | Sudo et al. | 400/120 |
| 5,579,043 A | | 11/1996 | Patry | 347/222 |
| 5,631,690 A | * | 5/1997 | Tashiro et al. | 347/220 |
| 5,833,380 A | * | 11/1998 | Hosomi et al. | 400/621 |
| 5,993,093 A | * | 11/1999 | Schoennauer et al. | 400/621 |

FOREIGN PATENT DOCUMENTS

| | | |
|---|---|---|
| EP | 0-764585 | 3/1997 |
| JP | 63-182156 | 11/1988 |
| JP | 3-275375 | 12/1991 |
| JP | 8-142445 | 6/1996 |
| WO | 98/43820 | 10/1998 |

* cited by examiner

*Primary Examiner*—Daniel J. Colilla
(74) *Attorney, Agent, or Firm*—Hogan & Hartson, L.L.P.

(57) ABSTRACT

A printer positions the platen and print head in separate frames, and a stationary blade and movable blade in the separate frames, and aligns the two pair of elements independently from inaccuracy in alignment of the two separate frames to maintain the print quality of the printing mechanism and the cutting performance of the paper cutting mechanism. A support mechanism 50 has an installation frame 51 fixed to the cover 3, a support frame 52 for supporting a platen roller 12 and stationary blade 41, and a compression spring 53 attached to the installation frame 51 and support frame 52. The support frame 52 can move relative to the installation frame 51 pivotally around engaging pin 52*c* of the support frame 52, and slidably relative to the pivot of the cover 3. A positioning pin 61 and a positioning notch 62 are provided on the main frame 4 for positioning the support frame 52 to a position at which the platen roller 12 and stationary blade 41 are aligned to and positioned opposite the thermal head 11 and movable blade 32 respectively.

13 Claims, 6 Drawing Sheets

PRINTER HAVING A MEDIUM TRANSPORTATION PATH OPEN/CLOSE MECHANISM

BACKGROUND OF THE INVENTION

1. Field of the Invention

The present invention relates to a printer suitable for use in a point-of-sale (POS) system, for example, and relates more particularly to a mechanism for opening and closing the print medium transportation path for loading the print medium to the printer.

2. Description of Related Art

Printers of this type generally have a printing mechanism for printing to a print medium in roll form, referred to simply as roll paper below. A typical printing mechanism has a print head and a platen. When roll paper is loaded into the printer, it is necessary to hold the paper unrolled from the paper roll by the printing mechanism or, more precisely to pinch it between the print head and the platen. For convenience, the platen is therefore usually disposed to the cover for covering a compartment for the roll paper while the print head is disposed on the printer frame so that the roll paper transportation path can be opened and closed. When the cover is then closed, the roll paper is pressed against the print head by the platen so that the printer prints on the roll paper held between the print head and platen.

Some printers of this type also have a paper cutting mechanism on the downstream of the printing mechanism along the paper transportation path in the paper transportation direction for cutting the printed roll paper for issuing a receipt, for example.

This paper cutting mechanism, or paper cutter, typically has a movable blade and a stationary blade on opposite sides of the paper transportation path. The stationary blade is typically on the cover and the movable blade is on the printer frame. When the cover is closed, the movable blade is positioned opposite the stationary blade with the paper transportation path therebetween so that the paper disposed between the movable blade and stationary blade can be cut by sliding the movable blade crosswise to the stationary blade. An exemplary printer of this type is taught, for example, in U.S. Pat. No. 5,579,043.

One of the drawbacks to a printer such as this is that because the platen of the printing mechanism is provided on an operable cover for opening and closing the paper transportation path, engagement of the platen and print head can vary when the cover is closed if there is any play in the support shaft on which the cover opens and closes. This can lead to a drop in print quality.

Another drawback to such printers having a paper cutting mechanism is that because the stationary blade of the cutting mechanism is provided on an operable cover for opening and closing the paper transportation path, engagement of the stationary blade and movable blade will not be consistent when the cover is closed if there is any play in the support shaft on which the cover opens and closes. This can lead to deficient cutting of the print medium.

Furthermore, the distance between the cover support shaft and the printing mechanism and paper cutting mechanism is great in a printer of this type in which roll paper of a large diameter can be used, and the same problems occur when the dimensional precision of the cover is poor or cover rigidity is low.

The present invention seeks to solve these problems with the related art by holding the platen and print head of the printing mechanism appropriately positioned to each other, and thereby provide a printer capable of maintaining high print quality, regardless of the positioning precision of the cover support shaft or the dimensional precision or rigidity of the cover.

Furthermore, by holding the stationary blade and movable blade of the paper cutting mechanism appropriately positioned to each other regardless of the characteristics of the cover, the present invention seeks to provide a printer that is free of the above paper cutting problems.

SUMMARY OF THE INVENTION

To achieve these objects, a printer according to the present invention has a cover (a first frame), a printing mechanism, a support member, and an alignment mechanism. The cover is disposed in a manner that it can be opened or closed with respect to a printer frame (a second frame), in which there is a transportation path for a recording medium, so that the recording medium transportation path can be opened or closed by moving the cover toward or away from the printer frame. The printing mechanism has a print head and platen disposed so that they can move to or away from each other with the recording medium transportation path therebetween. When these are moved to make the recording medium transportation path in mutually opposing positions, the printing mechanism can print to the recording medium passes between the platen and print head. The support member is movably mounted on the cover and supports either the print head or platen of the printing mechanism. When the cover is moved to the closed position to define the recording medium transportation path, the alignment mechanism is so configured as to align the one part, that is, the platen or the print head, mounted on the support member to the other part.

Even if the cover shifts slightly from the ideal opening and closing path due to variations in the positioning precision of a pivot of the cover on the printer frame, for example, the support member is aligned by the alignment mechanism to the predetermined position relative to the printer frame. In one embodiment of the present invention, the aligning mechanism comprises a guide mechanism and a holding mechanism. When the cover is moved to the closed position, the support member is guided to move to the predetermined relative position. Then, the support member is held in the position by the holding mechanism. To facilitate the above alignment operation, it is preferable to provide an elastic member between the cover and the support member. The elastic member positions the support member in a predetermined relative position range with respect to the cover thus configuring the guide mechanism when the support member first abut on the printer frame. It is further preferable to provide a stopper to regulate relative movement range of the support member to make engagement of the guide mechanism surer.

A printer according to the present invention further preferably comprises a pair of cutting blades disposed adjacent to the recording medium transportation path on the downstream side of the printing mechanism with the blades disposed movably to or away from each other with the recording medium transportation path located therebetween, and crosswise slideably to each other so that a print medium disposed therebetween can be cut when the blades are in a mutually opposing position. It is yet further beneficial that one of these blades is supported on the support member whereby the cutter blades are positioned to each other.

When the cover is closed to the printer frame according to one embodiment of the present invention, the support member is moved as described above to a position for aligning the printing mechanism. Because one of the blades is supported on the support member, thus positioning the support member also determines the mutual positions of the cutter blades.

Therefore, by thus positioning the cutter blades to a position at which they can slide crosswise relative to each other, a recording medium printed by the printing mechanism can be reliably cut by the cutter blades, and the cutting performance of the cutting blades can be maintained.

Other objects and attainments together with a fuller understanding of the invention will become apparent and appreciated by referring to the following description and claims taken in conjunction with the accompanying drawings.

DESCRIPTION OF THE PREFERRED EMBODIMENTS

A preferred embodiment of a printer according to a preferred embodiment of the present invention is described in detail below with reference to the accompanying figures.

Figure 1:
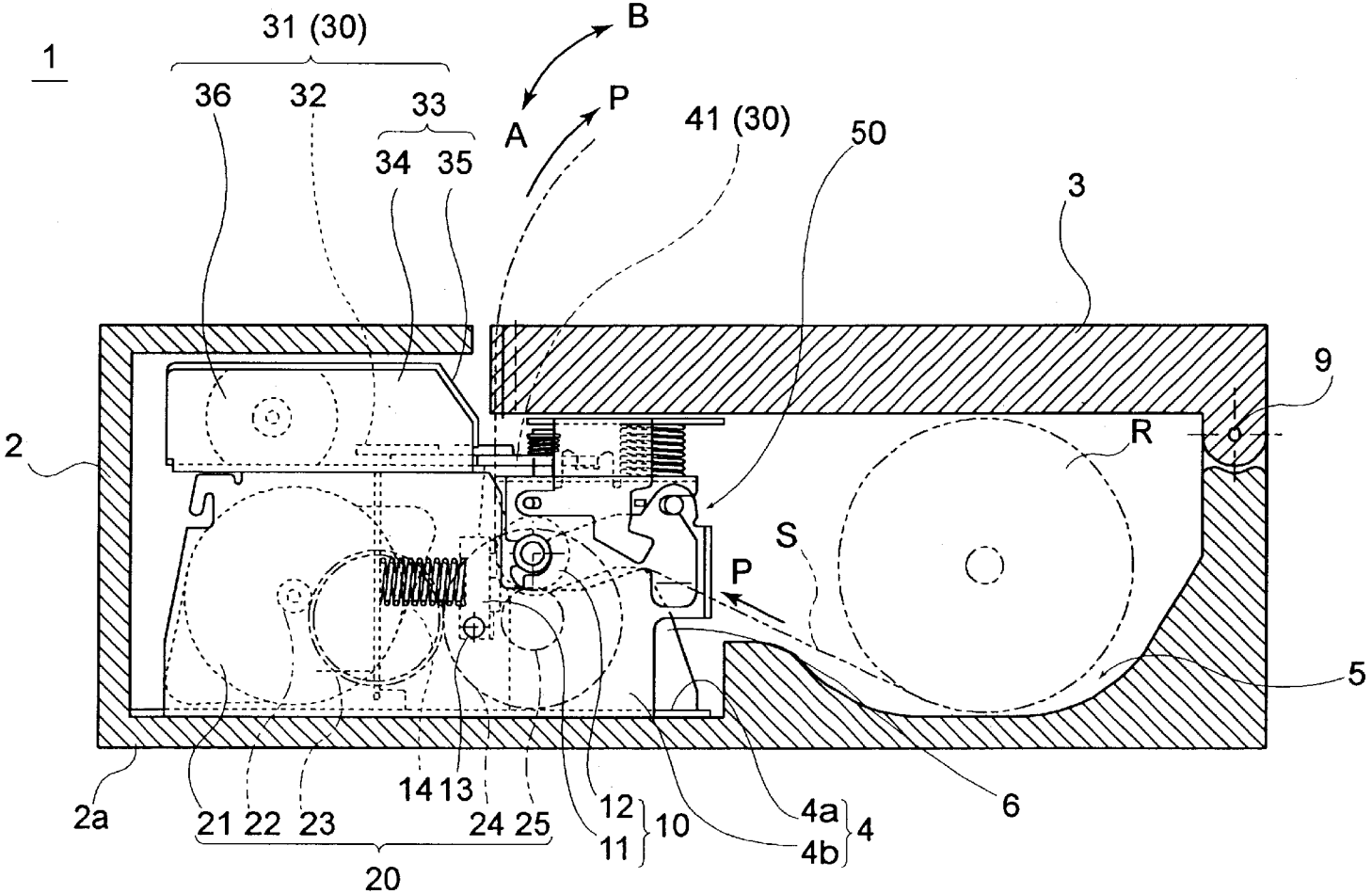
FIG. 1 shows the schematic configuration of a printer according to a preferred embodiment of the invention.
Figure 2:
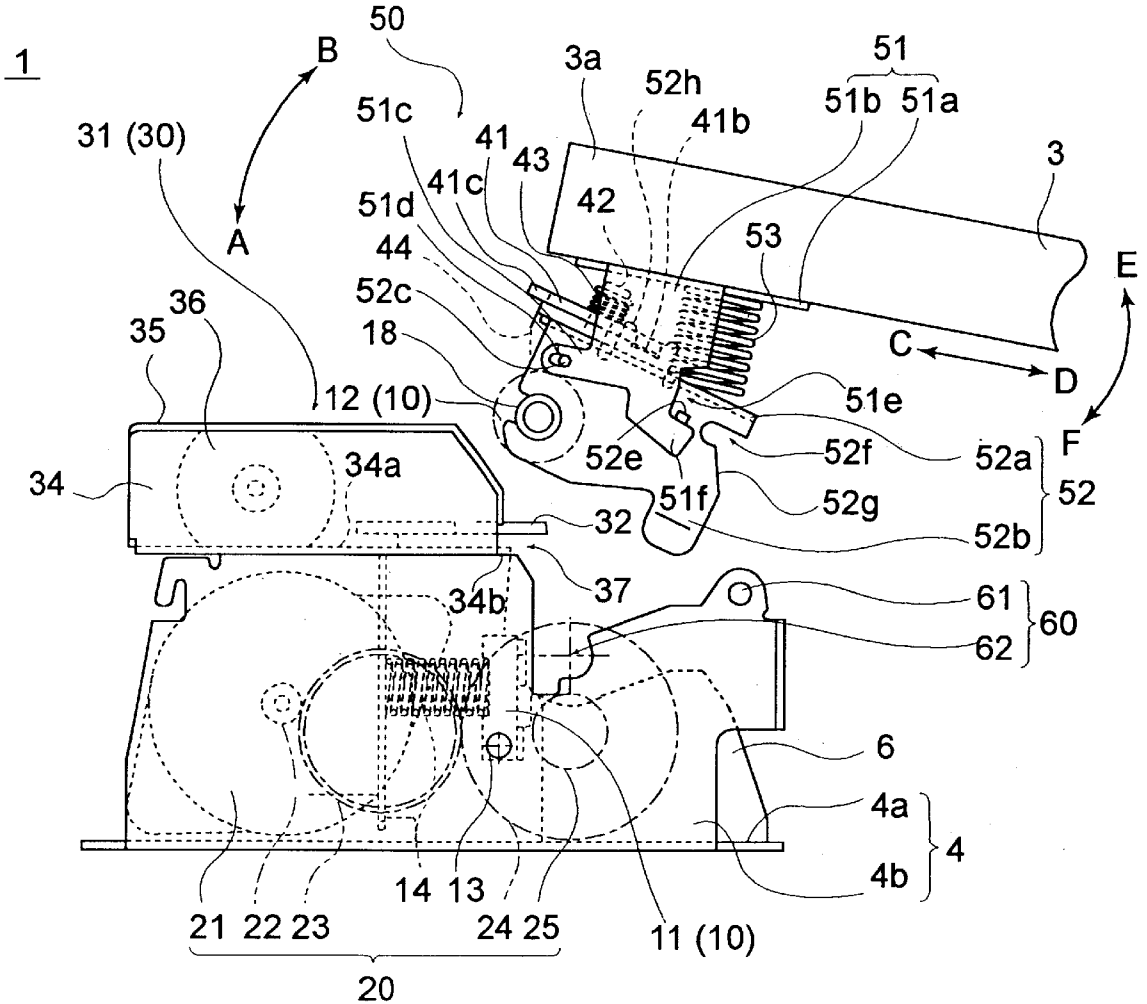
FIG. 2 shows the schematic configuration of the preferred embodiment when the printer cover is open.
Figure 3:
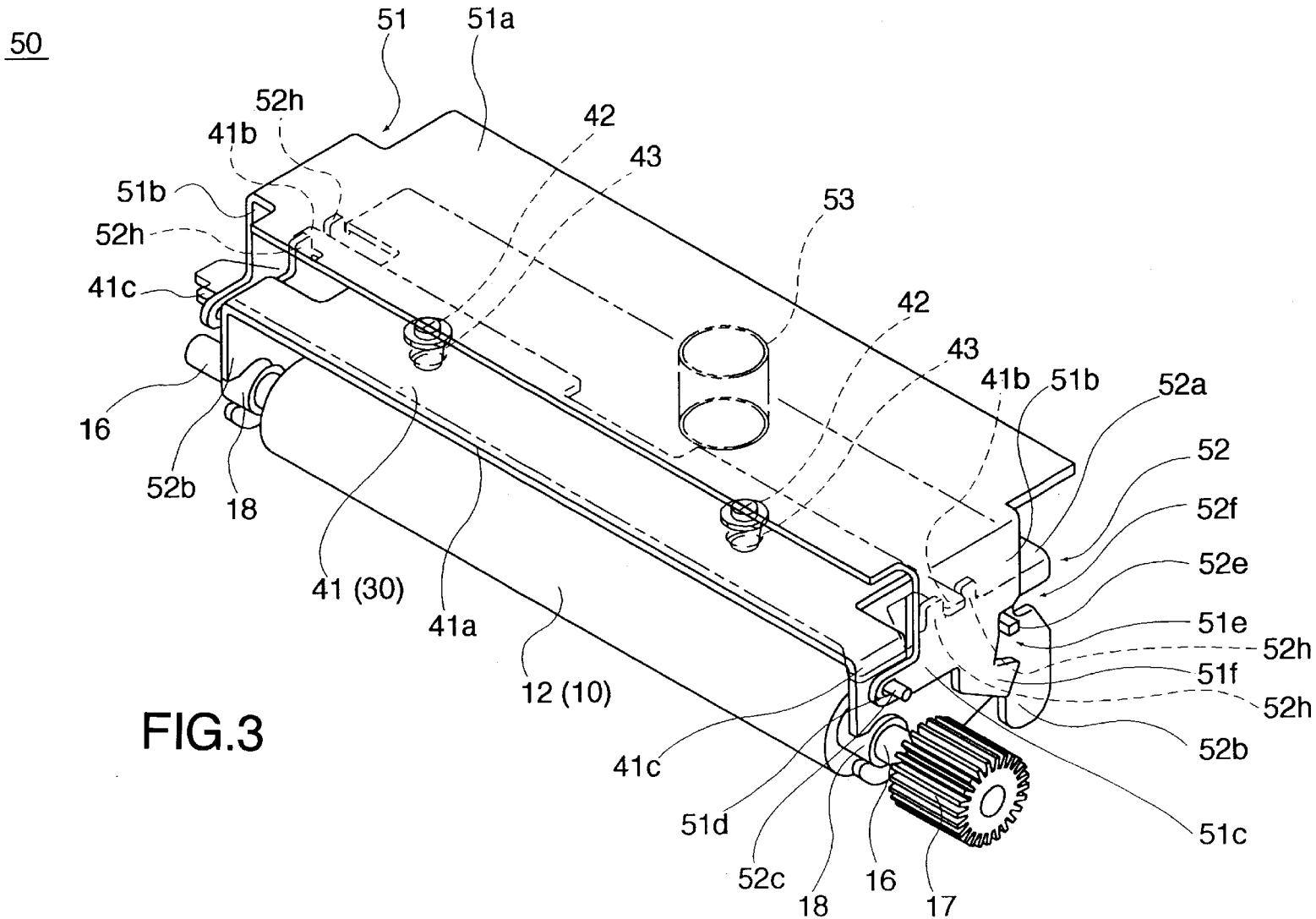
FIG. 3 is a perspective view of the support mechanism part in this preferred embodiment.
Figure 4:
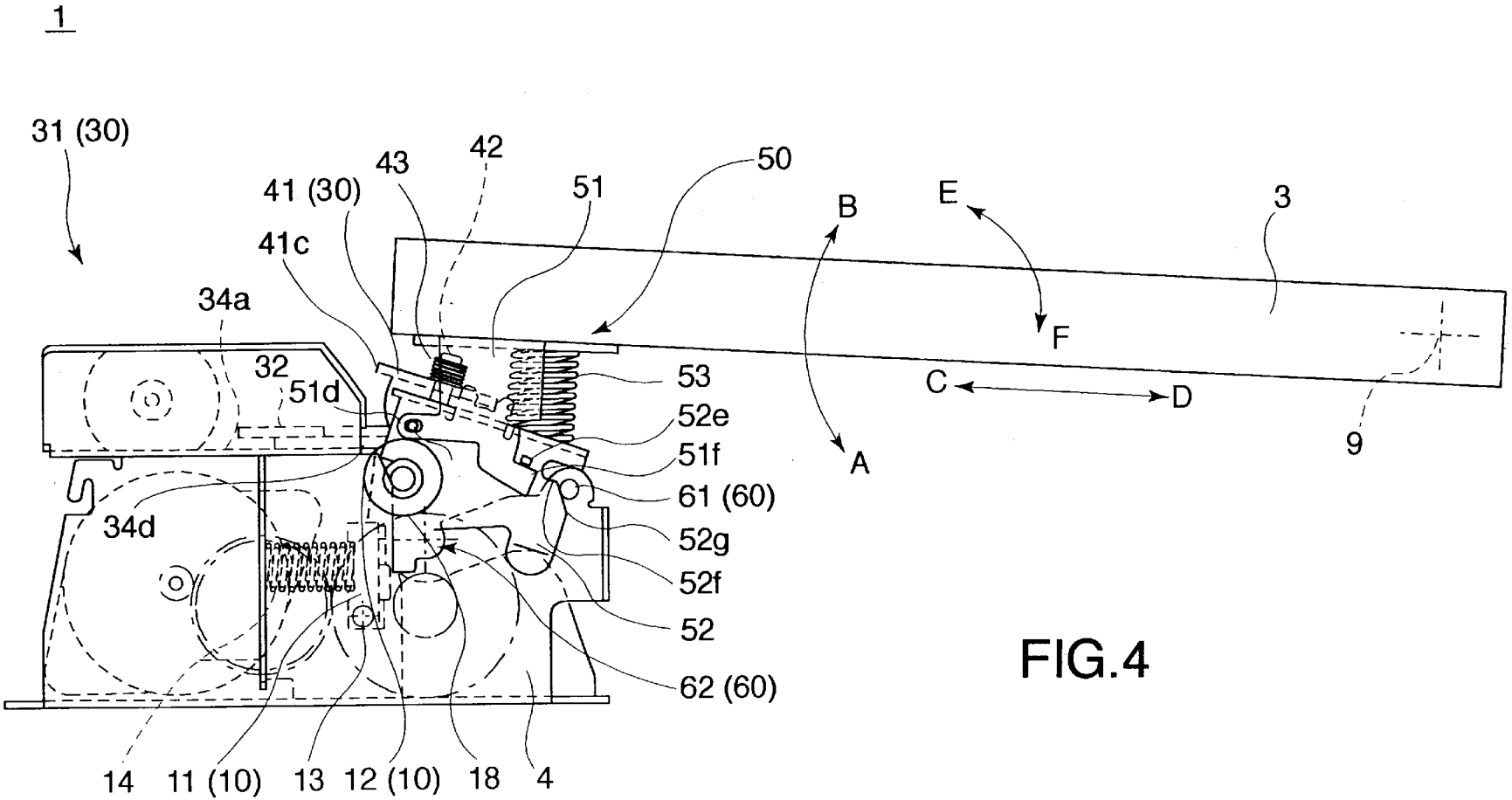
FIG. 4 shows the support mechanism part of this preferred embodiment when movement thereof begins.
Figure 5:
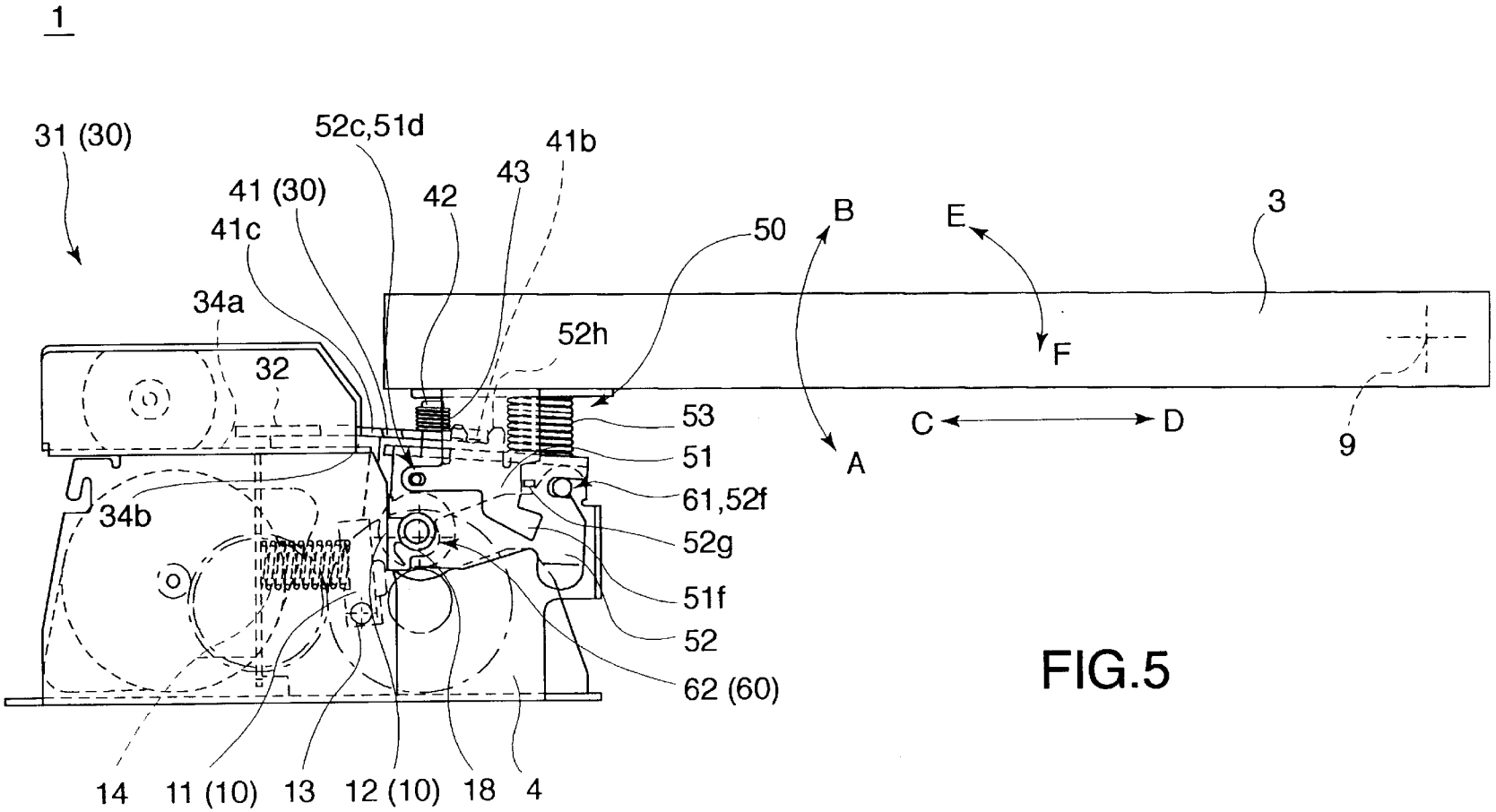
FIG. 5 shows the support mechanism part of this preferred embodiment immediately before its movement ends.
Figure 6:
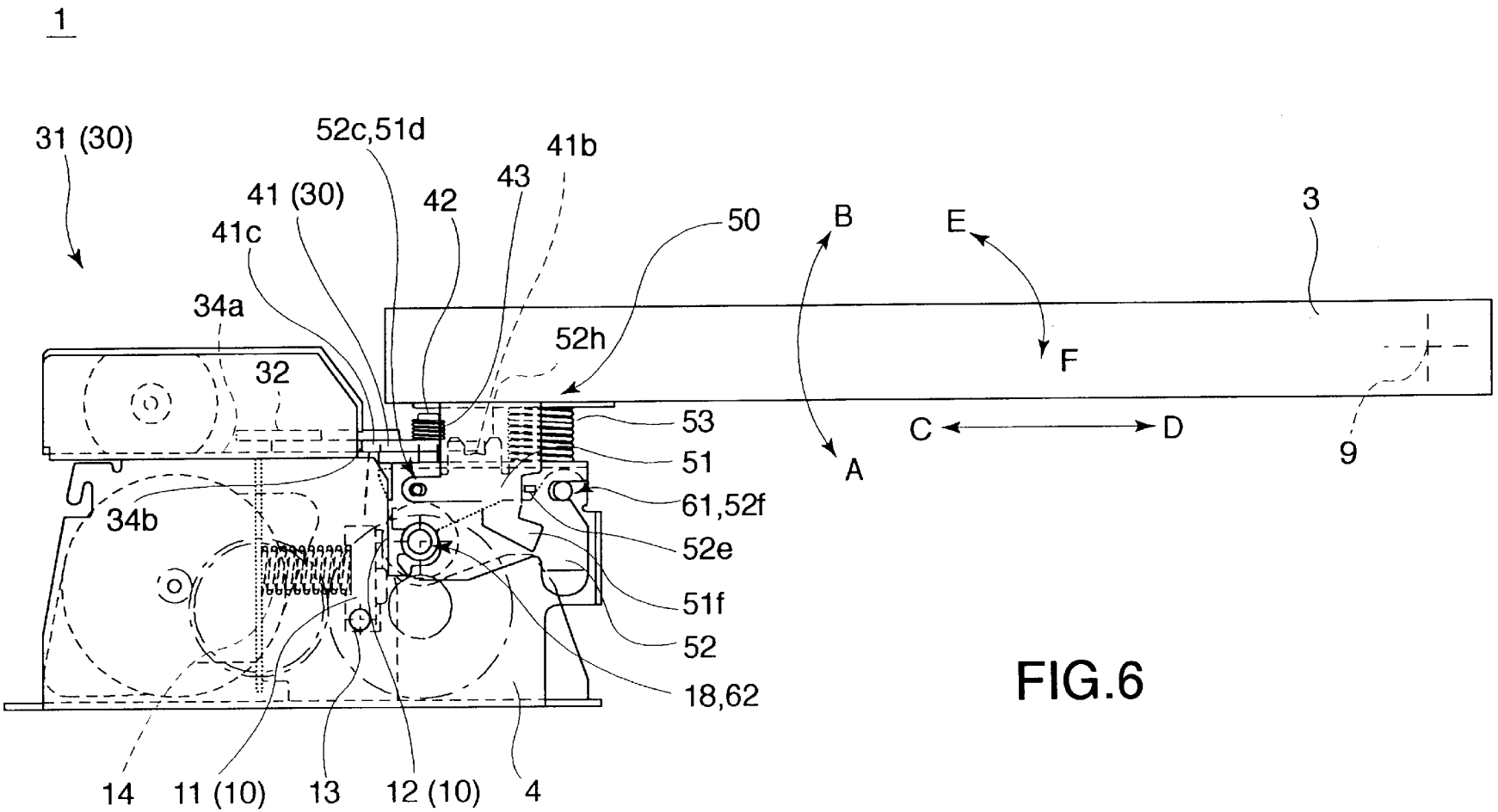
FIG. 6 shows the support mechanism part of this preferred embodiment when support mechanism part movement has ended.

FIG. 1 shows a schematic configuration of a printer in accordance with a preferred embodiment of the invention. FIG. 2 shows the schematic configuration of the printer when the printer cover is open. FIG. 3 is a perspective view of a support mechanism part in the preferred embodiment. FIG. 4 shows the support mechanism part of the preferred embodiment when movement thereof begins; FIG. 5 shows the support mechanism part immediately before its movement ends; and FIG. 6 shows the support mechanism part when the movement of the support mechanism part has ended.

As shown in FIG. 1, a printer 1 according to this preferred embodiment of the invention has a box shaped main case 2. The main case 2 may be made of a resin material, for example. A cover 3 is supported on a support shaft 9 at the top front part (top right as seen in FIG. 1) of the main case 2 so that the cover 3 can be opened and closed freely on support shaft 9 in the direction of arrows A and B. The cover 3 is shorter than the length in the longitudinal direction of a rectangular bottom 2*a* of the main case 2. When closed, the cover 3 is substantially parallel to the bottom 2*a* of the main case 2.

A main frame 4, typically made of metal, is disposed inside the main case 2 at the back side of the main case 2 (left side as seen in FIG. 1). The main frame 4 has a bottom 4*a* and a pair of parallel sides 4*b* formed with the bottom 4*a* therebetween. A paper guide 6 forming a paper transportation path P is disposed at a place on the front side of the main frame 4.

A roll paper compartment 5 for holding roll paper R is disposed inside the main case 2 at the front side thereof (right side as seen in FIG. 1).

As shown in FIGS. 1 and 2, the printer 1 also has a printing mechanism 10 for printing to the roll paper S paid out from the roll paper R in the roll paper compartment 5 through the paper transportation path P, and a cutting mechanism (cutter blade) 30 for cutting the printed roll paper S.

The printing mechanism 10 comprises a thermal head (print head) 11 for printing by means of a heat sensitive method, and a platen roller (platen) 12 for supporting the roll paper S between itself and the thermal head 11.

The thermal head 11 is disposed downstream of the roll paper compartment 5 in the direction of paper travel along the paper transportation path P, and is pivotally disposed to the main frame 4 so as to rotate about a support shaft 13. The thermal head 11 is also urged toward the paper transportation path P by a head pressure spring 14.

The platen roller 12 is disposed to a support mechanism 50 in a manner further described below. The support mechanism 50 is disposed toward the end of the cover 3 opposing the paper transportation path P.

When the cover 3 is closed, the platen roller 12 is disposed opposite the thermal head 11 with the paper transportation path P therebetween.

A drive mechanism 20 for rotationally driving the platen roller 12 is mounted on the main frame 4. The drive mechanism 20 comprises a drive motor 21 in an area to the back side of the main frame 4. Rotational drive power of the drive motor 21 is transferred from a motor gear 22 to an intermediate gear 24 by way of a reduction gear 23. A further gear member 25 is disposed beside and coaxially to an intermediate gear 24.

Referring to FIG. 3, a platen gear 17 is fixed to one end of a platen shaft 16 of the platen roller 12 so that when the cover 3 is closed, the platen gear 17 meshes with the gear member 25, and the platen roller 12 can thus be rotationally driven in a desired direction.

Referring again to FIGS. 1 and 2, a cutting mechanism 30 comprises a cutter unit 31 having a movable blade 32 and a stationary blade 41.

The cutter unit 31 is disposed downstream of the printing mechanism 10 in the paper travel direction along the paper transportation path P, and an upper portion of the main frame 4. The cutter unit 31 has a cutter case 33 comprising a cutter frame 34 and a cutter cover 35. The cutter frame 34 has a bottom 34*a* and an edge 34*b* at the bottom 34*a*. The movable blade 32 is provided inside the cutter case 33, as is a cutter motor 36 for driving the movable blade 32.

At one side of the cutter case 33 is an opening 37 through which the movable blade 32 is extended and retracted. The opening 37 is connecting to the paper transportation path P. The edge 34*b* of the bottom 34*a* of the cutter frame 34 is formed slightly projecting from opening 37 at the bottom edge of the opening 37.

The rotational drive force from the cutter motor 36 is transferred by, for example, intervening gears (not shown in the figures) to the movable blade 32 disposed in the cutter unit 31. The movable blade 32 thus reciprocates between an extended position (the solid lined position in FIG. 2) at which the movable blade 32 moves out from the opening 37 of the cutter case 33 and crosses the paper transportation path P, and a retracted position (the dotted lined position in FIG. 2) at which the movable blade 32 is stored inside the cutter case 33.

The stationary blade 41 is disposed to the support mechanism 50 fixed to the cover 3 so that when the cover 3 is closed, the stationary blade 41 is positioned opposite the movable blade 32 of the cutter unit 31 with the paper transportation path P located therebetween.

As shown in FIG. 2, the support mechanism 50 comprises an installation frame 51 disposed to the cover 3, a support frame (support member) 52 disposed to the installation frame 51, and a coil compression spring (flexible member) 53 provided between the installation frame 51 and the support frame 52. As noted above, the platen roller 12 of the printing mechanism 10 and the stationary blade 41 of the cutting mechanism 30 are disposed to the support frame 52 of the support mechanism 50.

The support frame 52 is designed to move relative to the installation frame 51 within a specified range of movement, and is held against the installation frame 51 by the urging force of the compression spring 53.

The installation frame 51 has a mounting part 51*a* and two parallel arms 51*b* with the mounting part 51*a* between the parallel arms 51*b*, forming a bracket opening downward. The arms 51*b* are positioned orthogonally to the cover 3 as a result of the mounting part 51*a* being fastened to the leading end 3*a* of cover 3.

The support frame 52 likewise has a base 52*a* and two parallel arms 52*b* with the base 52*a* therebetween forming a bracket opening downward. The distance between the arms 52*b* of the support frame 52 is slightly shorter than the distance between the arms 51*b* of the installation frame 51, and slightly longer than the gap between the sides 4*b* of the main frame 4.

An engaging pin 52*c* is fixed projecting to the outside of each of the arms 52*b* at the end of both arms 52*b* of the support frame 52. A protrusion 51*c* projecting in the lengthwise direction (referred to below as the "cover edge direction") of the cover 3 indicated by an arrow C in FIG. 2 is formed at the end of each of the arms 51*b* of the installation frame 51. An oval engaging hole 51*d* long in the directions C and D is formed in each of the protrusions 51*c* for engaging each of the pin 52*c* of the support frame 52.

The engaging pins 52*c* of the support frame 52 are fit with a slight amount of play in engaging the holes 51*d* of the installation frame 51 with the arms 52*b* of the support frame 52 accommodated inside the arms 51*b* of the installation frame 51. As a result, the support frame 52 is movably supported to the installation frame 51 so that it can move in the direction C or D, and pivot about the engaging pins 52*c* as indicated by arrows E and F.

An engaging tab 52*e* protruding to the outside of the arm 52*b* is formed at the back end of each of the arms 52*b* of the support frame 52. An arc-shaped regulating channel 51*e* roughly centered on the engaging hole 51*d* is further formed at the back edge part of the arms 51*b* of the installation frame 51. A regulator tab 51*f* for engaging the tab 52*e* of the support frame 52 is further formed at the bottom end of the regulating channel 51*e*.

When the support frame 52 is supported on the installation frame 51, the engaging tab 52*e* of the support frame 52 is positioned in the regulating channel 51*e* of the installation frame 51, thus limiting the movement of the support frame 52 to the installation frame 51 in the direction E or F.

When the force of the compression spring 53 pushes the engaging tab 52*e* of the support frame 52 against the regulator tab 51*f* of the installation frame 51, the support frame 52 is held in a predetermined angle, e.g., in this embodiment, inclined to the installation frame 51 in the direction F.

Furthermore, since the force of the compression spring 53 pushes the engaging pin 52*c* of the support frame 52 to one end of the engaging hole 51 d in the installation frame 51, the support frame 52 is held in a predetermined position, e.g., in this embodiment slightly offset to the installation frame 51 in the direction D.

A positioning mechanism 60 having a positioning notch (engagement holder) 62 and a positioning pin (engagement guide) 61 for positioning the support mechanism 50 to a predetermined position is further disposed to the main frame 4.

The support mechanism 50 is thus formed so that when the cover 3 is closed, the platen roller 12 and the stationary blade 41 are positioned and aligned to the thermal head 11 and the movable blade 32, respectively, by the positioning mechanism 60.

It should be noted that the positioning pin 61 is fixed at the front top of each of the sides 4*b* of the main frame 4 projecting to the outside of the sides 4*b*. In addition, an engaging notch 52*f* for engaging the positioning pin 61, and a guide edge 52*g* for guiding the positioning pin 61 to the engaging notch 52*f*, are formed in the back edge part of each of the arms 52*b* of the support frame 52.

As shown in FIG. 3, a bearing member 18 for rotatably supporting the platen shaft 16 to support the frame 52 is affixed at the end of each of the arms 52*b* of the support frame 52. The platen roller 12 is supported freely rotatably to the support frame 52 by these bearing members 18. As shown in FIG. 2, the positioning notch 62 is formed to substantially the same shape and size as part of the outside profile of the bearing member 18 in each of the sides 4*b* of the main frame 4 at a position opposite the thermal head 11.

As shown in FIGS. 2 and 3, an engaging protrusion 41*b* is formed on each side of the stationary blade 41. A supporting protrusion 52*h* is also formed protruding from the base 52*a* on each of the arms 52*b* of the support frame 52. A stationary blade 41 is thus rockably supported to the support frame 52 as a result of the protrusions 41*b* being supported on the supporting protrusions 52*h*.

With studs 42 fastened to the base 52*a* of the support frame 52 passing through the stationary blade 41, the stationary blade 41 is held with the part around the edge 41 a thereof pressed against the base 52*a* of the support frame 52 by the force of the compression spring 43 attached to the studs 42 and the stationary blade 41.

It should be noted that a blade cover 44 for covering an edge 41*a* of the stationary blade 41 is thus disposed to the base 52*a* of the support frame 52. The blade cover 44 (not shown in FIG. 3) can be made from a thin metal plate fixed to the base 52*a* and bent upward in front of the stationary blade 41 to cover the stationary blade 41 when the support frame 52 is detached from the main frame 4 and the stationary blade abuts on the base 52*a*.

The support mechanism 50 is thus comprised so that when the cover 3 is closed, the support frame 52 is positioned with the base 52*a* thereof and the fixed part 51 a of the installation frame 51 substantially parallel as a result of the engaging notch 52*f* of the support frame 52 engaging the positioning pin 61 of the main frame 4.

When the support frame 52 is thus positioned, the bearing member 18 of the platen roller 12 is disposed in the positioning notch 62 of the main frame 4, and the platen roller 12 is thus positioned opposite the thermal head 11.

Furthermore, when the support frame 52 is thus positioned and ends 41*c* on both sides of the edge 41*a* engage the edge 34*b* at the bottom 34*a* of the cutter frame 34, the stationary blade 41 is positioned with the stationary blade 41 and the base 52*a* of the support frame 52 substantially parallel, and at a position where a sliding action can be achieved with the movable blade 32.

Referring to FIG. 1 and FIG. 2, when the cover 3 is swung in the direction of arrow A as shown in FIG. 2 to close the paper transportation path P and the roll paper compartment 5 in order to print to roll paper S, the guide edge 52*g* of the support frame 52 slides over the positioning pin 61 of the main frame 4 in conjunction with rotation of the cover 3 in the direction of arrow A (see FIG. 4).

When the cover 3 is then further rotated in the direction of arrow A, the positioning pin 61 of the main frame 4 fits into the engaging notch 52*f* of the support frame 52 in resistance to the force of the compression spring 53. More specifically, as a result of the repulsion received by the support frame 52 from the positioning pin 61 resisting the force of the compression spring 53, the engaging notch 52*f* of the support frame 52 rotates about the positioning pin 61 in the direction E and moves parallel to cover radius direction C with respect to the installation frame 51 as shown in FIG. 5, and thus fits into the positioning pin 61 of the main frame 4.

This action also causes the bearing members 18 of the platen roller 12 to approach the positioning notch 62 of the main frame 4, and the stationary blade 41 to approach the edge 34*b* of the cutter frame 34.

When the cover 3 is then closed as shown in FIG. 6, the bearing members 18 of the platen roller 12 engages the positioning notch 62 of the main frame 4, and the support frame 52 is thus engaged.

In this position the platen roller 12 is held and positioned opposite the thermal head 11 with the thermal head 11 pressed against the platen roller 12 by the force of the head pressure spring 14.

Furthermore, with the ends 41*c* of the stationary blade 41 engaged with the edge 34*b* of the cutter frame 34 in resistance to the force of the compression spring 43, the stationary blade 41 rotates about the engaging protrusion 41*b* supported by the supporting protrusion 52*h* of the support frame 52. As a result, the stationary blade is aligned and positioned slideably to the movable blade 32 with the edge 41*a* thereof exposed upward from the blade cover 44.

The platen roller 12 is then rotated to feed the roll paper S through the paper transportation path P while driving the thermal head 11 according to the print data received from a host device to print on the roll paper S. The roll paper S can then be cut by sliding the movable blade 32 across the stationary blade 41.

It will thus be obvious that the support frame 52 can move partially independently of the opening and closing movement of the cover 3 in a printer according to this preferred embodiment of the invention. As a result, the platen roller 12 can be positioned to the thermal head 11 completely independently of the position at which the cover 3 is closed and irrespective of the positioning precision of the support shaft 9 of the cover 3.

It is therefore possible by means of the present invention to maintain the print quality of the printing mechanism 10.

Furthermore, because the stationary blade 41 is likewise supported on the support frame 52, the stationary blade 41 can be positioned to a crosswise sliding position with the movable blade 32 in the same way that the printing mechanism 10 is positioned.

It is therefore possible by means of the present invention to maintain the cutting performance of the cutting mechanism 30.

It will also be obvious that the present invention shall not be limited to the preferred embodiment described above, and can be varied in many ways.

For example, the platen roller 12 is disposed to the support frame 52 in the above exemplary embodiment. However, it is also possible to dispose the thermal head 11 to the support frame 52, and the platen roller 12 to the main frame 4. However, the preferred embodiment described above may be more desirable from the viewpoint of protecting the thermal head 11.

Furthermore, the above-described configuration of the support mechanism part 50 is but one possible example of the many variations whereby the support mechanism 50 can be moved for alignment partially independently of the opening and closing action of the cover 3.

In addition, a thermal head 11 is used as the print head in the printing mechanism 10 described above, but other printing methods, including but not limited to ink jet and dot impact methods, can also be used. However, the present invention is effective when applied with a printing mechanism that prints with the print head pressed against the platen roller 12, similarly to the above-described thermal head 11.

As will be known from the preceding description, a printer of the present invention can maintain the print quality of the printing mechanism by assuring the relative positioning of the platen and print head parts of the printing mechanism without being affected by the positioning precision of the cover support shaft.

Furthermore, a printer of the present invention can also maintain the cutting performance of the paper cutting mechanism by assuring the relative positioning of the stationary blade and movable blade of the paper cutting mechanism without being affected by the positioning precision of the cover support shaft.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

What is claimed is:

1. A printer having a first frame for mounting either one of a print head or a platen, and a second frame openable and closeable with respect to the first frame and mounting the other one of the print head or the platen, the printer comprising:

a supporting member provided movably on the first frame for supporting the one of the print head or the platen supported on the first frame; and a guide mechanism for guiding the supporting member to a first predetermined position while the first and second frames are being closed with respect to each other, wherein the guide mechanism comprises a pivot mechanism having:

a shaft provided on one of the supporting member or the second frame; and a notch provided on the other one of the supporting member or the second frame for engaging the shaft.

2. A printer according to claim 1 further comprising:

an elastic member disposed between the first frame and the supporting member for positioning the supporting member to a second predetermined position relative to the first frame when the first and the second frames are opened with respect to each other, and for allowing the guide mechanism to guide the supporting member to the first predetermined position when the supporting member abuts on the second frame.

3. A printer according to claim 2 further comprising:

a stopper for stopping the relative movement of the supporting member with respect to the first frame at the first predetermined position.

4. A printer according to claim 1 wherein the guide mechanism further comprises:

a guide surface disposed adjacent to the notch for guiding the shaft to the notch when the first and second frames are closed with respect to each other.

5. A printer according to claim 1 wherein the guide mechanism further comprises:

a sliding mechanism for guiding sliding movement of the supporting member with respect to the first frame when the first and second frames are closed with respect to each other.

6. A printer according to claim 5 wherein the sliding mechanism comprises:

a protrusion disposed on one of the supporting member and the first frame; and a slot disposed on the other one of the supporting member and the first frame for accommodating the protrusion.

7. A printer according to claim 1 wherein the printer further comprises:

a platen shaft in concentric with the platen for rotating the platen;

a bearing for rotatably mounting the platen shaft on the one of the supporting member or the second frame;

a receiving notch disposed on the other one of the supporting member or the second frame for receiving the bearing therein; and a resilient member for pressing the print head against the platen so that the bearing is placed inside of the receiving notch.

8. A printer according to claim 1 further comprising:

a stationary blade mounted on one of the supporting member or the second frame; and a movable blade mounted on the other one of the supporting member or the second frame for cutting, in cooperation with the stationary blade, a recording medium printable by the print head.

9. A printer according to claim 1, wherein the first frame further comprises:

a mounting member for movably mounting the supporting member on the first frame.

10. A printer according to claim 8 further comprising:

an elastic member disposed between the mounting member and the supporting member for positioning the supporting member at the first predetermined position relative to the mounting member when the first and the second frames are opened with respect to each other.

11. A printer according to claim 10 further comprising:

a stopper for stopping the relative movement of the supporting member with respect to the mounting member at the predetermined position.

12. A printer according to claim 9 wherein the guide mechanism further comprises:

a sliding mechanism for guiding sliding movement of the supporting member with respect to the mounting member when the first and second frames are closed with respect to each other.

13. A printer according to claim 12 wherein the sliding mechanism comprises:

a protrusion disposed on one of the supporting member and the mounting member; and a slot disposed on the other one of the supporting member and the mounting member for accommodating the protrusion.

* * * * *